US008912716B2

(12) United States Patent
Hwang et al.

(10) Patent No.: US 8,912,716 B2
(45) Date of Patent: Dec. 16, 2014

(54) COPPER CORE COMBUSTION CUP FOR PRE-CHAMBER SPARK PLUG

(75) Inventors: Jeongung Hwang, Northville, MI (US); Nicholas C. Polcyn, Commerce, MI (US); Christopher Thomas, Oakland, MI (US)

(73) Assignee: DENSO International America, Inc., Southfield, MI (US)

( * ) Notice: Subject to any disclaimer, the term of this patent is extended or adjusted under 35 U.S.C. 154(b) by 890 days.

(21) Appl. No.: 13/052,651

(22) Filed: Mar. 21, 2011

(65) Prior Publication Data

US 2012/0242215 A1 Sep. 27, 2012

(51) Int. Cl.
*H01T 13/20* (2006.01)
*H01T 13/54* (2006.01)

(52) U.S. Cl.
CPC ..... *H01T 13/54* (2013.01)
USPC ..... 313/143

(58) Field of Classification Search
CPC ..... H01T 13/54
USPC ..... 313/143
See application file for complete search history.

(56) References Cited

U.S. PATENT DOCUMENTS

| | | | | |
|---|---|---|---|---|
| 6,460,506 | B1 | 10/2002 | Nevinger | |
| 6,783,870 | B2 * | 8/2004 | Haynes et al. | 428/653 |
| 7,210,447 | B2 * | 5/2007 | Robinet et al. | 123/255 |
| 2005/0000484 | A1 * | 1/2005 | Schultz et al. | 123/266 |
| 2005/0218771 | A1 | 10/2005 | Hrastnik et al. | |
| 2006/0144362 | A1 | 7/2006 | Robinet et al. | |

OTHER PUBLICATIONS

Office Action dated Feb. 18, 2014 for corresponding JP application No. 2012-052083 with English translation.

* cited by examiner

*Primary Examiner* — Anh Mai
*Assistant Examiner* — Hana Featherly
(74) *Attorney, Agent, or Firm* — Harness, Dickey & Pierce, P.L.C.

(57) ABSTRACT

A spark plug for an internal combustion engine includes a spark plug housing. An insulator is concentrically located within the housing and has a distal end extending from an outer surface of the housing. A center electrode extends from a proximal end of the insulator. A ground electrode is secured to the housing and has an electrode tip arranged a distance from the center electrode. A chamber cap fixedly secured to the housing and surrounding both the center and ground electrodes, includes a laminate shell and a plurality of orifices.

23 Claims, 4 Drawing Sheets

COPPER CORE COMBUSTION CUP FOR PRE-CHAMBER SPARK PLUG

FIELD

The present disclosure relates to spark plugs for internal combustion engines and, more particularly, to a pre-chamber spark plug having a copper core combustion cup.

BACKGROUND

The statements in this section merely provide background information related to the present disclosure and may not constitute prior art. Spark plugs have long been used as igniting means for internal combustion engines of motor vehicles or the like. The spark plug typically includes a center electrode and a ground electrode between which a sparking gap is provided. By applying a high voltage across the center electrode and the ground electrode, a spark discharge takes place in the sparking gap, thereby generating a flame kernel between the center electrode and the ground electrode. As the flame propagates, an air-fuel mixture within the combustion chamber of the engine ignites.

In recent years and due to an increasing demand for low emissions and high efficiency, improvements have been made to better control this combustion process. For example, by encapsulating the spark plug, it is possible to improve mixing of fuel and air and to control initiation of the spark. In such an arrangement, however, the spark plug may experience an increased temperature environment, which tends to reduce its active life. Attempts to alleviate these problems have included insulating the electrodes from one another, as disclosed in U.S. Pat. No. 6,460,506, which issued to Nevinger on Oct. 8, 2002. However, even when employing such a spark plug design, there is still opportunity to reduce heat transfer between the chamber cap and the surrounding environment.

SUMMARY

This section provides a general summary of the disclosure, and is not a comprehensive disclosure of its full scope or all of its features.

A spark plug for an internal combustion engine includes a spark plug housing. An insulator is concentrically located within the housing and has a distal end extending from an outer surface of the housing. A center electrode extends from a proximal end of the insulator. A ground electrode is secured to the housing and has an electrode tip arranged a distance from the center electrode. A chamber cap fixedly secured to the housing and surrounding both the center and ground electrodes, includes a laminate shell and a plurality of orifices.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
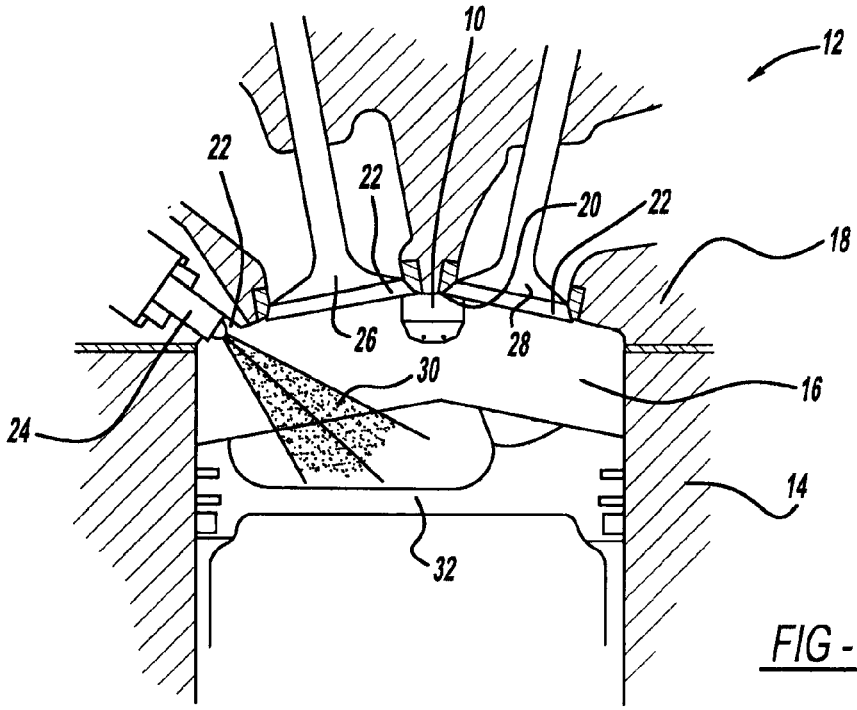
FIG. 1 is a partial cross-sectional view of a direct-injection engine cylinder having a pre-chamber spark plug according to the present invention.

Example embodiments will now be described more fully with reference to FIGS. 1-6 of the accompanying drawings. It should be understood that throughout the drawings, corresponding reference numerals indicate like or corresponding parts and features. Example embodiments are provided so that this disclosure will be thorough, and will fully convey the scope to those who are skilled in the art. Numerous specific details are set forth herein, such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies will not be described in detail.

Referring now to FIG. 1, at least one spark plug 10 may be arranged within each cylinder 12 of an internal combustion engine 14 of a motor vehicle, a cogeneration system, or a gas pressure feed pump. The spark plug 10 may be used as an igniting means for initiating combustion within the combustion chamber 16. The cylinder 12 is typically bounded by an engine block 18, which may be an iron or aluminum alloy casting. The spark plug 10 may be located at an upper portion 20 of the engine block 18 by means known in the art. For example, the engine block 18 may have a threaded bore (not shown) for removably receiving the spark plug 10.

The cylinder 12 may have a plurality of openings 22 for receiving a fuel injector 24, at least one intake valve 26, and at least one exhaust valve 28. In operation, the fuel injector 24 and intake valve 26 open to allow an amount of air and fuel 30 to enter the combustion chamber 16 at a specified ratio. A piston 32, located within the cylinder 12, moves upwardly to compress the air-fuel mixture. A voltage is then applied at the spark plug 10 igniting the compressed air-fuel mixture. Finally, the exhaust valve 28 is opened to expel the byproducts of the combustion.

Figure 2:
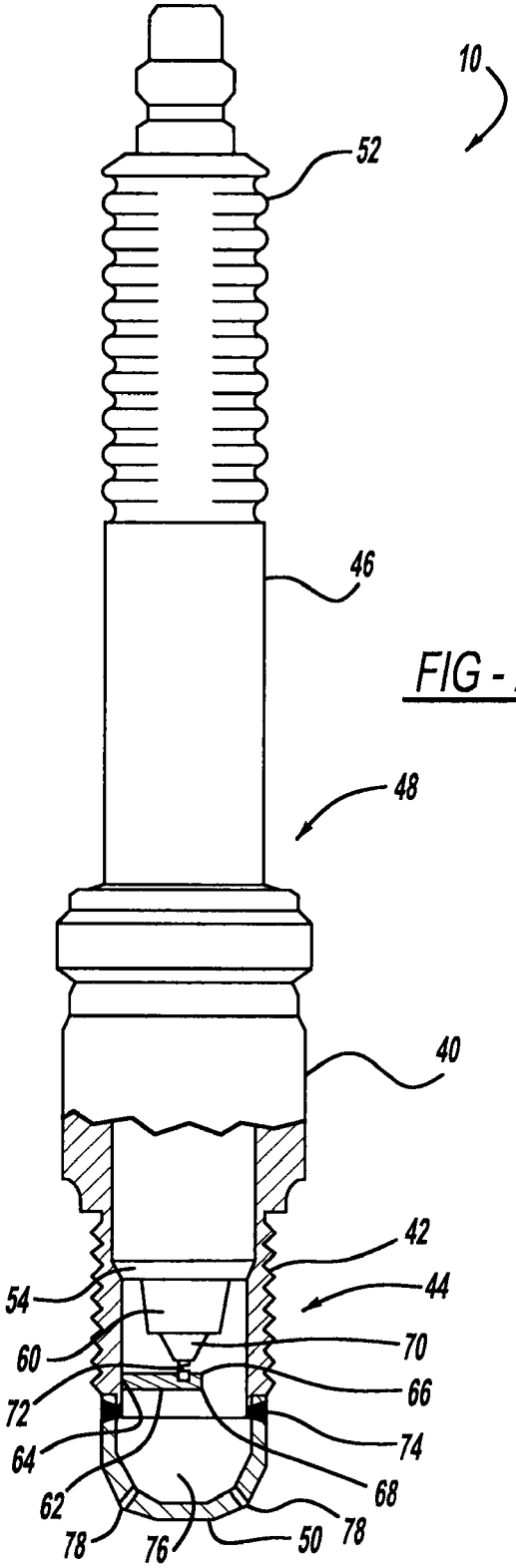
FIG. 2 is a partial cross-sectional view of a first embodiment of the pre-chamber spark plug of FIG. 1.

With reference now to FIG. 2, the spark plug 10 may include a cylindrical metal housing 40, a plurality of mounting threads 42 at a lower portion 44 of the housing 40, an insulator 46 protruding outwardly from an upper portion 48 of the housing 40, and a chamber cap 50 secured to the lower portion 44 of the housing 40. The housing 40 may be made of electrically conductive steel (e.g., low carbon steel) for withstanding the torque of tightening the spark plug 10 into the engine block 18, removing excess heat from the spark plug 10, and dispersing the excess heat to the engine block 18. The mounting threads 42 may be formed around an external surface of the housing 40 for attachment into the engine block 18. The insulator 46 may be a porcelain material (e.g., an alumina ceramic), which is fixedly and coaxially supported within the housing 40 along a central axis Y. The insulator 46 may include a distal end 52 that extends from the upper portion 48 of the housing 40 and a proximal end 54 that extends through the mounting threads 42. The length of the insulator 46 may be modified to provide an appropriate length for the spark plug 10 per engine design, such that it is more readily accessible for service.

The insulator 46 may also fixedly retain a center electrode 60 in an electrically insulated state. The center electrode 60 may extend from the proximal end 54 of the insulator 46. A ground electrode 62 may be arranged a predetermined distance (e.g., 0.5 to 1.0 mm) from the center electrode 36. The ground electrode 62 may have a rectangular columnar configuration, with a fixed end 64 secured to the housing 40 by welding. An electrode tip 66 may be secured at a free end 68 of the ground electrode 62. The electrode tip 66 may be arranged in a face-to-face (e.g., opposing) relationship with a first end 70 of the center electrode 60 by a sparking gap 72.

The chamber cap 50 may be secured to the lower portion 44 of the housing 40 by a weld 74. The weld 74 may extend circumferentially around the chamber cap 50 at the lower portion 44 of the housing 40 so as to fixedly secure the chamber cap 50 to the housing 40. The weld 74 may be created through any known welding process (e.g., laser welding). Material for the weld 74 is selected to withstand the substantial forces exerted during the combustion process. The chamber cap 50 may be used to separate the center and ground electrodes 60, 62 from turbulence in the combustion chamber 16. The chamber cap 50 may be formed from a conventional material (e.g., a nickel alloy). While the chamber cap 50 is described as a protection device for the center and ground electrodes 60, 62, the chamber cap 50 may also serve to establish an ignition chamber 76 for controlled ignition of the fuel-air mixture. As such, the chamber cap 50 may include a plurality of orifices 78 for allowing the air-fuel mixture from the combustion chamber 16 to enter the ignition chamber 76. Notably, the orifices 78 also behave as a passageway for byproducts of the combustion process to exit the chamber cap 50.

Operation of the spark plug 10 will now be described with reference to FIGS. 1 and 2. The fuel injector 24 and the intake valve 26 are opened to supply a specified air-fuel ratio to the combustion chamber 16. The air-fuel mixture is forced into the chamber cap 50 through orifices 78 during the intake stroke of the piston 32. A voltage is then applied across the center electrode 60 and the electrode tip 66 of the ground electrode 62, creating a plasma arc in the sparking gap 72. This spark discharge ignites the air-fuel mixture, which initiates as a flame kernel between the center and ground electrodes 60, 62. The flame kernel is then jetted out of the orifices 78 during the combustion stroke of the piston 32, creating individual ignition torches specifically dispersed around the chamber cap 50.

Figure 3:
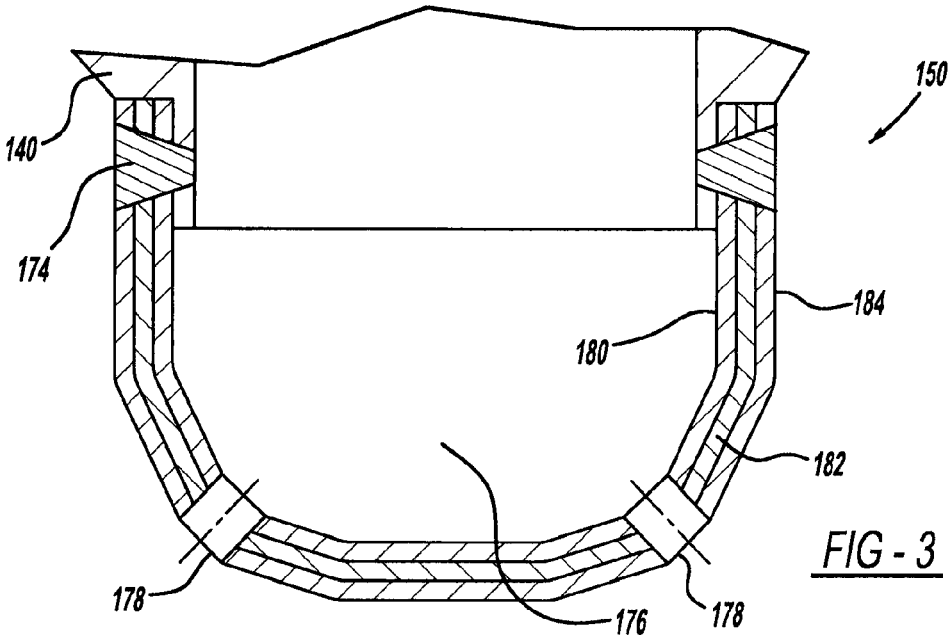
FIG. 3 is an enlarged, cross-sectional view of a first embodiment of a chamber cap for the pre-chamber spark plug of FIG. 2.

With reference now to FIG. 3, a chamber cap 150 similar to that of FIG. 2 is shown secured to a housing 140 by a weld 174. The weld 174 may be created through any known welding process and may extend circumferentially around the chamber cap 150 of the housing 140, as previously described. The chamber cap 150 may be a laminate construction having an inner layer 180, a core layer 182, and an outer layer 184. A plurality of orifices 178 may extend from the inner layer 180 to the outer layer 184 so as to penetrate the core layer 182 for allowing the air-fuel mixture from the combustion chamber 16 to enter the ignition chamber 176. Notably, the orifices 178 also behave as a passageway for byproducts of the combustion process to exit the chamber cap 150. The inner and outer layers 180, 184 may be formed from a conventional alloyed material (e.g., nickel), while the core layer 182 may be formed from an alloyed material having a higher thermal conductivity (e.g., copper). In this way, the chamber cap 150 may cool rapidly as the chamber cap 150 channels heat to the housing 140 and into the water jacket (not shown).

The chamber cap 150 may also serve to establish an ignition chamber 176 for controlled ignition of the air-fuel mixture. As previously described with respect to spark plug 10, the air-fuel mixture is forced into the chamber cap 150 through orifices 178. After ignition of the air-fuel mixture, the flame kernel jets out of the orifices 178, creating individual ignition torches around the chamber cap 150.

Figure 4:
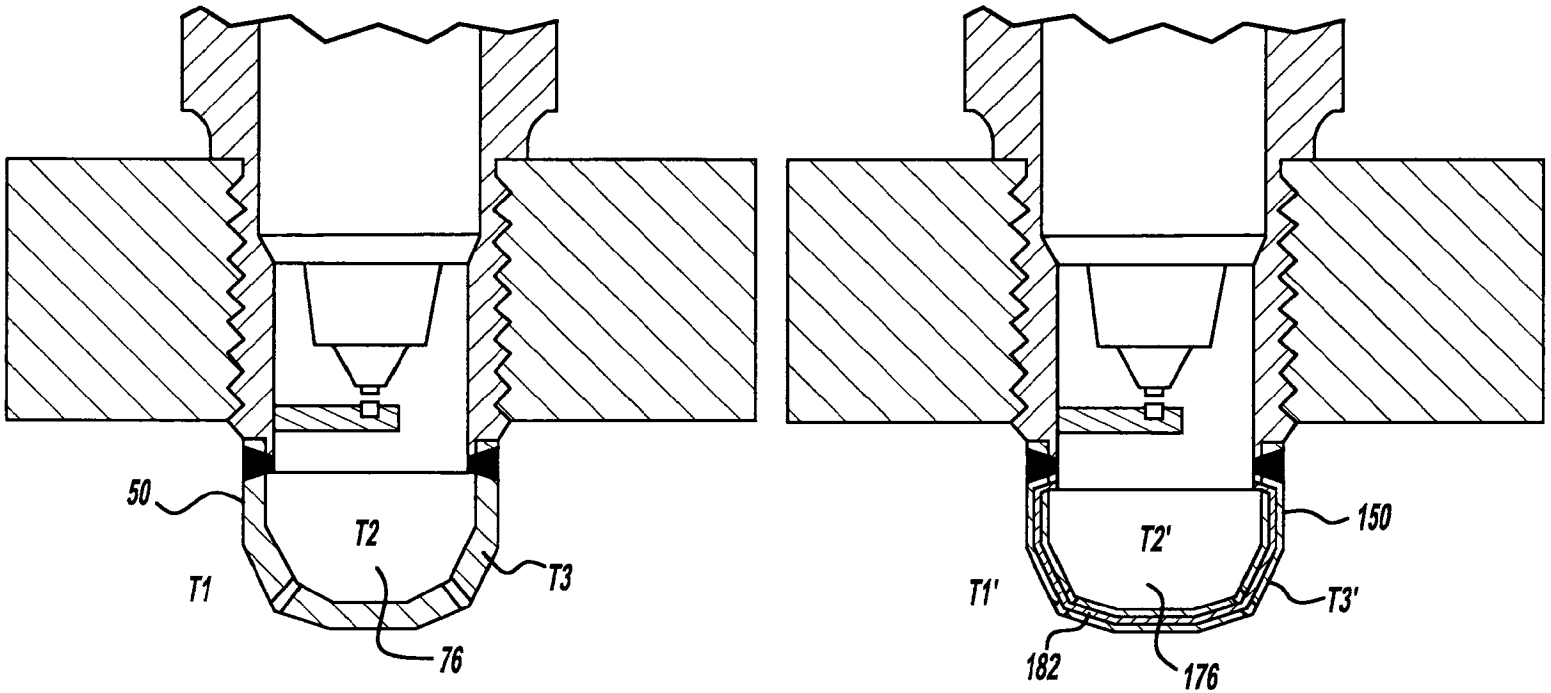
FIG. 4 is a comparison view of a temperature differential for a prior art spark plug and the pre-chamber spark plug of FIG. 2.

The temperature variance between the chamber cap 50 and the chamber cap 150 is described with respect to FIG. 4. As can be seen, a temperature value T1 is representative of a temperature outside of the chamber cap 50 (e.g., in the combustion chamber 16), while T1' represents a temperature outside of the chamber cap 150. Similarly, a temperature value T2 is representative of a temperature inside the chamber cap 50 (e.g., in the ignition chamber 76), while T2' represents a temperature inside the chamber cap 150 (e.g., in the ignition chamber 176). Likewise, a temperature value T3 is representative of a temperature of the chamber cap 50 directly, while T3' represents a temperature of the chamber cap 150.

$$T1+T2+T3>T1'+T2'+T3'$$

However, the effects of temperature reduction on T1' and T2' due to the higher thermally conductive material at the core layer 182 are negligible. Therefore, these values cancel each other leaving:

$$T3>T3'$$

This temperature reduction results in a longer life expectancy for the spark plug 10.

Figure 5:
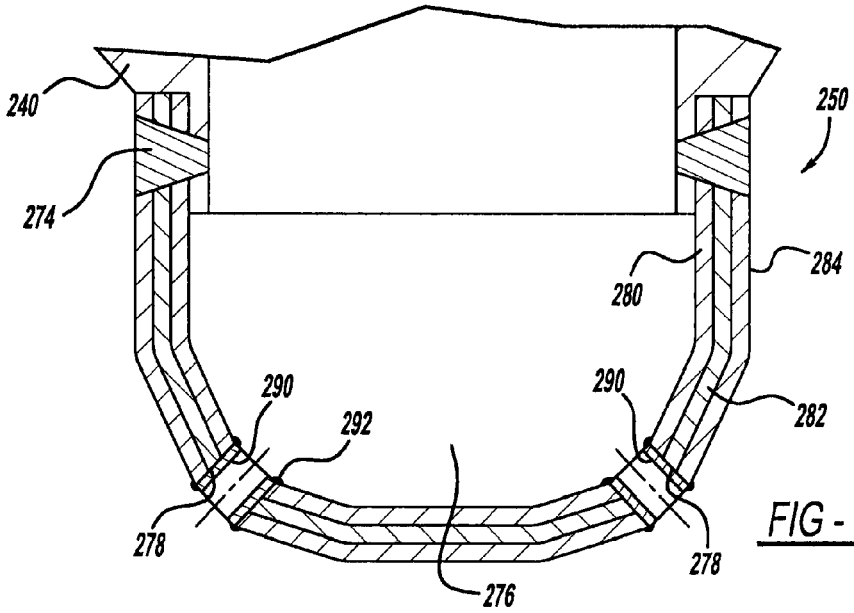
FIG. 5 is an enlarged, cross-sectional view of a second embodiment of a chamber cap for the pre-chamber spark plug of FIG. 2.

With reference now to FIG. 5, a chamber cap 250 similar to that of FIG. 3 is shown secured to a housing 240 by a weld 274. As previously described, the weld 274 may be created through any known welding process and may extend circumferentially around the chamber cap 250 of the housing 240. The chamber cap 250 may also be a laminate construction having an inner layer 280, a core layer 282, and an outer layer 284. The chamber cap 250 may have a plurality of orifices 278 that extend from the inner layer 280 to the outer layer 284 for allowing the air-fuel mixture from the combustion chamber 16 to enter the ignition chamber 276 and for allowing byproducts of the combustion process to exit the chamber cap 250. The inner and outer layers 280, 284 may be formed from a conventional material (e.g., nickel), while the core layer 182 may be formed from a material having a higher thermal conductivity (e.g., copper) to improve cooling time for the chamber cap 250. Certain materials for the core layer 182, however, may suffer from oxidation due to the environment in the ignition chamber 276.

Accordingly, the chamber cap 250 may include a plurality of sleeves 290 secured within the plurality of orifices 278. The sleeves 290 may be used to prevent oxidation of the core layer 282. The sleeves 290 may be formed from a metal (e.g., aluminum) and may be secured within the orifices 278 through a welding process (e.g., laser welding). The weld bead 292 may be along both the perimeter of the sleeve 290 at an interface between the sleeve 290 and the inner layer 280 and between the sleeve 290 and the outer layer 284. In this way, the core layer 282 is protected as the air-fuel mixture is forced into the chamber cap 250 through orifices 278 and as the flame kernel jets out of the orifices 278.

Figure 6:
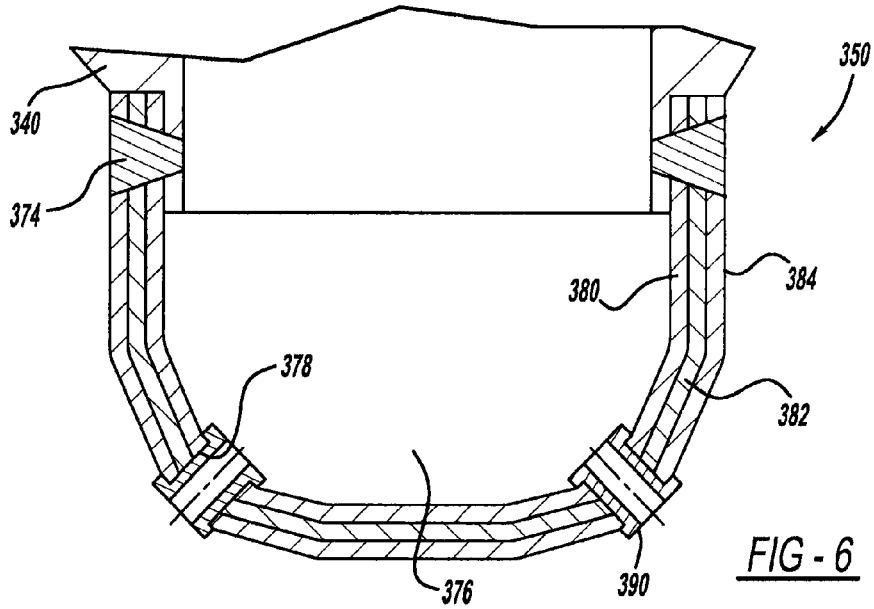
FIG. 6 is an enlarged, cross-sectional view of a third embodiment of a chamber cap for the pre-chamber spark plug of FIG. 2.

With reference now to FIG. 6, a chamber cap 350 similar to that of FIG. 5 is shown secured to a housing 340 by a weld 374. In nearly all respects, the chamber cap 350 is similar to that of the chamber cap 250 (e.g., includes a plurality of orifices 378, an inner layer 380, a core layer 382, and an outer layer 384), and, therefore, will not be described in detail herein. The chamber cap 350, however, includes a plurality of press fittings 390 in place of the plurality of sleeves 290. The press fittings 390 may similarly be used to prevent oxidation of the core layer 382. The press fittings 390 may be formed from a metal (e.g., aluminum) and may be secured within the orifices 378 through a press-fit operation. In this way, the core layer 382 is protected as the air-fuel mixture is forced into the chamber cap 350 through orifices 378 and as the flame kernel jets out of the orifices 378. While the press fittings 390 are described as being formed from a metal material, it should be understood that any material capable of withstanding the high temperature environment of the ignition chamber 376 may be used.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A spark plug for an internal combustion engine, the spark plug comprising:

a spark plug housing;

an insulator concentrically located within the housing and having a distal end extending from an outer surface of the housing;

a center electrode extending from a proximal end of the insulator;

a ground electrode secured to the housing and having an electrode tip arranged a distance from the center electrode; and a chamber cap fixedly secured to the housing and surrounding both the center and ground electrodes, the chamber cap including a laminate shell having a plurality of orifices; wherein the housing includes a plurality of mounting threads;

a weld fixedly secures the chamber cap to the housing; and the weld extends circumferentially around the chamber cap at a position spaced from a position where the chamber cap directly contacts the housing.

2. The spark plug of claim 1, wherein the laminate shell further comprises an inner layer, a core layer, and an outer layer.

3. The spark plug of claim 2, wherein the inner layer and outer layer are formed from a conventional alloyed material.

4. The spark plug of claim 3, wherein the conventional alloyed material is nickel.

5. The spark plug of claim 2, wherein the core layer is formed from an alloyed material having a higher thermal conductivity than that of nickel.

6. The spark plug of claim 5, wherein the alloyed material is copper.

7. The spark plug of claim 2, wherein the plurality of orifices extend from the inner layer, through the core layer, to the outer layer.

8. The spark plug of claim 7, further comprising a plurality of sleeves corresponding to the plurality of orifices, wherein each sleeve is fixedly retained within a corresponding orifice.

9. The spark plug of claim 8, wherein the plurality of sleeves are formed from a metallic material.

10. The spark plug of claim 9, wherein the metallic material is aluminum.

11. The spark plug of claim 8, wherein each sleeve is fixedly retained to the corresponding orifice by one of a weld and an interference fit.

12. The spark plug of claim 1, wherein:

the laminate shell includes an inner layer, an outer layer and a core layer disposed between the inner and outer layers;

the housing has a joined portion joined with the chamber cap;

the joined portion includes a tubular portion and a step portion;

the tubular portion extends from the step portion;

the tubular portion is disposed within a chamber defined by the chamber cap;

an annular surface is formed on the step portion radially outside of the tubular portion; and the annular surface is opposed to an end surface of the chamber cap and is in direct contact with the end surface of the chamber cap, the annular surface covers the end surface of the chamber cap such that the core layer is not exposed to a piston cylinder of the internal combustion engine.

13. A chamber cap secured to a spark plug housing of a spark plug for an internal combustion engine, the chamber cap comprising:

an inner layer and an outer layer being formed from a conventional material;

a core layer arranged between the inner and outer layers, the core layer being formed from an alloyed material having a higher thermal conductivity than that of the conventional material;

a plurality of orifices extending from the inner layer through the core layer to the outer layer; and a plurality of sleeves fixedly secured within the plurality of orifices; wherein the housing includes a plurality of mounting threads;

a weld fixedly secures the chamber cap to the housing; and the weld extends circumferentially around the chamber cap at a position spaced from a position where the chamber cap directly contacts the housing.

14. The chamber cap of claim 13, wherein the conventional material is nickel.

15. The chamber cap of claim 13, wherein the alloyed material is copper.

16. The chamber cap of claim 13, wherein each sleeve of the plurality of sleeves is fixedly retained within a corresponding orifice of the plurality of orifices.

17. The chamber cap of claim 16, wherein each sleeve is fixedly retained to the corresponding orifice by one of a weld and an interference fit.

18. The chamber cap of claim 13, wherein the plurality of sleeves are formed from a metallic material.

19. The chamber cap of claim 18, wherein the metallic material is aluminum.

20. The spark plug of claim 13, wherein:

the housing has a joined portion joined with the chamber cap;

the joined portion includes a tubular portion and a step portion;

the tubular portion extends from the step portion;

the tubular portion is disposed within a chamber defined by the chamber cap;

an annular surface is formed on the step portion radially outside of the tubular portion; and the annular surface is opposed to an end surface of the chamber cap and is in direct contact with the end surface of the chamber cap, the annular surface covers the end surface of the chamber cap such that the core layer is not exposed to a piston cylinder of the internal combustion engine.

21. A spark plug, comprising:

a housing;

an insulator secured within the housing;

a center electrode extending from a proximal end of the insulator;

a ground electrode secured to the housing at a distance from the center electrode, wherein the distance establishes a sparking gap;

a laminate chamber cap fixedly secured to the housing and surrounding the center and ground electrodes, the laminate chamber cap having an inner layer, a core layer, and an outer layer, wherein the core layer has a higher thermal conductivity than that of the inner and outer layers; wherein the housing includes a plurality of mounting threads;

a weld fixedly secures the chamber cap to the housing; and the weld extends circumferentially around the chamber cap at a position spaced from a position where the chamber cap directly contacts the housing.

22. The spark plug of claim 21, wherein the core layer is a copper material.

23. The spark plug of claim 21, wherein:

the laminate shell includes an inner layer, an outer layer and a core layer disposed between the inner and outer layers;

the housing has a joined portion joined with the chamber cap;

the joined portion includes a tubular portion and a step portion;

the tubular portion extends from the step portion;

the tubular portion is disposed within a chamber defined by the chamber cap;

an annular surface is formed on the step portion radially outside of the tubular portion; and the annular surface is opposed to an end surface of the chamber cap and is in direct contact with the end surface of the chamber cap, the annular surface covers the end surface of the chamber cap such that the core layer is not exposed to a piston cylinder of the internal combustion engine.

* * * * *